US007528607B2

(12) United States Patent
Alger, II

(10) Patent No.: US 7,528,607 B2
(45) Date of Patent: May 5, 2009

(54) MEASUREMENT OF CN EMISSIONS FROM ENGINE SPARK IGNITER FOR CHARACTERIZATION OF SPARK IGNITER ENERGY

(75) Inventor: Terrence F. Alger, II, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 201 days.

(21) Appl. No.: 11/354,362

(22) Filed: Feb. 15, 2006

(65) Prior Publication Data

US 2006/0192563 A1 Aug. 31, 2006

Related U.S. Application Data

(60) Provisional application No. 60/653,021, filed on Feb. 15, 2005.

(51) Int. Cl.
*F02P 17/00* (2006.01)

(52) U.S. Cl. ..... 324/399; 123/143 B; 356/318; 73/23.31; 73/118.1

(58) Field of Classification Search ..... 324/399
See application file for complete search history.

(56) References Cited

U.S. PATENT DOCUMENTS

| | | | | |
|---|---|---|---|---|
| 3,576,462 | A | 4/1971 | Wanniger | 315/22 |
| 3,942,102 | A | 3/1976 | Kuhn et al. | 324/16 R |
| 4,393,687 | A | 7/1983 | Müller et al. | 73/35 |
| 4,723,438 | A | 2/1988 | Adler-Golden et al. | 73/23 |
| 4,766,318 | A | 8/1988 | Adler-Golden et al. | 250/385.2 |
| 5,153,673 | A | 10/1992 | Amirav | 356/315 |
| 5,194,813 | A | 3/1993 | Hannah et al. | 324/379 |
| 5,333,487 | A * | 8/1994 | Kimura et al. | 73/23.31 |
| 5,438,268 | A | 8/1995 | Schleupen et al. | 324/399 |
| 5,777,216 | A | 7/1998 | Van Duyne et al. | 73/116 |
| 5,933,009 | A | 8/1999 | Kayser | 324/399 |
| 2003/0074957 | A1 * | 4/2003 | Lemecha et al. | 73/118.1 |
| 2006/0037572 | A1 * | 2/2006 | Yalin et al. | 123/143 B |
| 2006/0119846 | A1 * | 6/2006 | Fichet et al. | 356/318 |

FOREIGN PATENT DOCUMENTS

| | | |
|---|---|---|
| JP | 11237315 | 8/1999 |

OTHER PUBLICATIONS

International Preliminary Report on Patentability and Written Opinion, PCT/US2006/005340, 6 pages.
International Search Report with Written Opinion PCT/US06/05340, 9 pages.

* cited by examiner

*Primary Examiner*—Timothy J Dole
*Assistant Examiner*—Benjamin M Baldridge
(74) *Attorney, Agent, or Firm*—Baker Botts L.L.P.

(57) ABSTRACT

A method and system for measuring the amount of energy released by a spark ignition system. This energy can be quantified spectroscopically by measuring the emission of cyanogen radicals in the presence of a ignition event and a known A/F ratio.

23 Claims, 1 Drawing Sheet

MEASUREMENT OF CN EMISSIONS FROM ENGINE SPARK IGNITER FOR CHARACTERIZATION OF SPARK IGNITER ENERGY

CROSS-REFERENCE TO RELATED APPLICATIONS

This application claims the benefit of U.S. Provisional Application No. 60/653,021 filed on Feb. 15, 2005, entitled "Measurement of CN Emissions from Engine Spark Igniter for Characterization of Spark Igniter Energy", which is incorporated herein by reference in its entirety.

TECHNICAL FIELD OF THE INVENTION

This invention relates to ignition systems for spark ignited engines, and more particularly to measuring energy delivered from a spark plug so that spark ignition systems can be better designed and evaluated.

BACKGROUND OF THE INVENTION

The government, as well as consumers, have stepped up their demands for low emissions and high fuel economy engines. In response, manufacturers are considering many new design options. One option is to use a highly dilute (EGR or air dilution) pre-mixed charge to increase engine efficiency and reduce emissions.

Today's engines equipped with conventional spark ignition systems have serious limitations as to the amount of dilution that is tolerable before unstable operation occurs. Ignition systems that are capable of delivering high levels of energy to the air/fuel mixture are a key factor in redesigning engines to run at highly dilute conditions.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

One aspect of spark plug design is the amount of energy delivered by the spark plug. Measuring the energy delivered to the plug is fairly easily accomplished using voltage and current probes. However, converting this electrical energy measurement to a thermal energy value is inefficient and depends on the design of the spark plug.

A non-invasive method of measuring the amount of energy delivered to the air would allow rapid testing of different spark ignition designs. The various designs can then be more effectively evaluated.

The method described herein is non-invasive and uses an optical chamber. It allows the measurement of spark energy in the presence of a flow field as well as a quiescent chamber. Thus, ignition system testing in accordance with the invention more realistically approaches the conditions encountered during engine operation. The method can be implemented in situ or as a benchtop rig.

Figure 1:
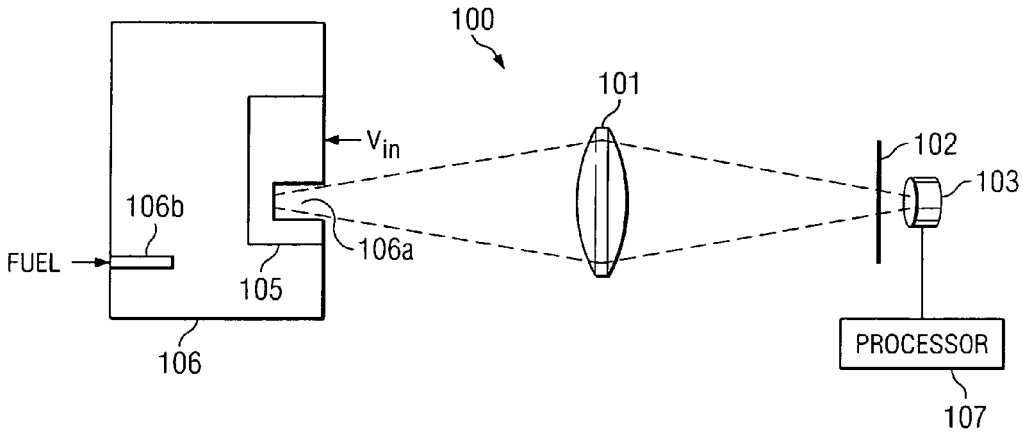
FIG. 1 illustrates a spark plug energy analysis system in accordance with the invention.

FIG. 1 illustrates a generalized layout of the system 100. As explained below, system 100 is used to analyze optical emissions from an igniter 105 in an optically accessible combustion chamber 106. Engine (not shown) may be a "real" engine, that is, the engine with which igniter 105 will actually be used.

Chamber 106 is similar in performance to a real combustion chamber, except that energy from igniter 105 is optically accessible by lenses 101 of system 100. This optical accessibility may be achieved by making all or a portion of the chamber wall from a material that will pass at least the optical wavelength of interest (here a wavelength of 388 nanometers). For example, cylinder 106 may have a window or wall of quartz.

The use of a realistic cylinder 106 will enhance testing in the sense that actual air flow patterns occur. For example, cylinder 106 may be shaped like a cylinder of an internal combustion engine, such that igniter 106 is enclosed in a geometry that simulates its configuration in an actual engine.

However, any chamber in which igniter 105 may operate to combust fuel can be used, so long as it is optically accessible by system 100. The optical accessibility may be the result of a window 106*a* that is open to the atmosphere outside the cylinder 106*a*. Alternatively, the window 106*a* may be made from a material that is optically conductive to cyanogen emissions, for the reasons explained below.

System 100 consists of a system of collecting lenses (one or more lenses) 101 in an optical path with a bandpass filter 102 and a high-speed, UV sensitive detector 103.

A known gas of known composition is used for the combustion of igniter 105. This ignitable mixture has a fixed and known A/F (air/fuel) and equivalence ratio (the actual air/fuel ratio divided by the air/fuel ratio at stoichiometry). Processor 107 may be used to control the delivery of gas to igniter 105. Comparisons of different igniters may be performed by using a combustion gas with constant characteristics (such as air-fuel and equivalence ratios). Known types of injectors 106*b* or similar devices may be used to deliver fuel into chamber 106.

In the example of this description, a spark plug is the ignition device (igniter 105), but the same concepts apply to any "igniter" of an engine ignition system. Typically, the igniter is of the type used for an internal combustion engine.

A test spark plug 105 is connected to means for igniting the plug 105, such as an electrical connection to an electrical power source (Vin). The plug 105 is fired, and the emissions from the spark gap are collected by lens system 101. The wavelength of interest is passed by filter 102, and is the wavelength associated with cyanogen (CN) emissions. Specifically, the wavelength is of the emission (388 nm) from the CN radical created during the spark discharge.

The level of CN emissions is detected by detector 103. Detector 103 may be any device sensitive to the wavelength of interest. Suitable devices include photodiode and photomultiplier tube devices.

Depending on spark plug design (hardware and electronics), different spark plugs (igniters) have different delivered energy levels. Because the A/F ratio is constant between each igniter, system-to-system differences can be measured by the level of CN emissions from the igniter under test. A large ionization volume and/or increased energy release both result in improved ignition system performance. Both of these factors will cause the CN emissions to increase.

Using processor 107, the signal from the CN radicals formed by the igniter 105, such as in the spark gap of a spark plug, can be integrated over the duration of the spark event.

The level of emission is then correlated to the amount of energy released by the ignition system.

Figure 2:
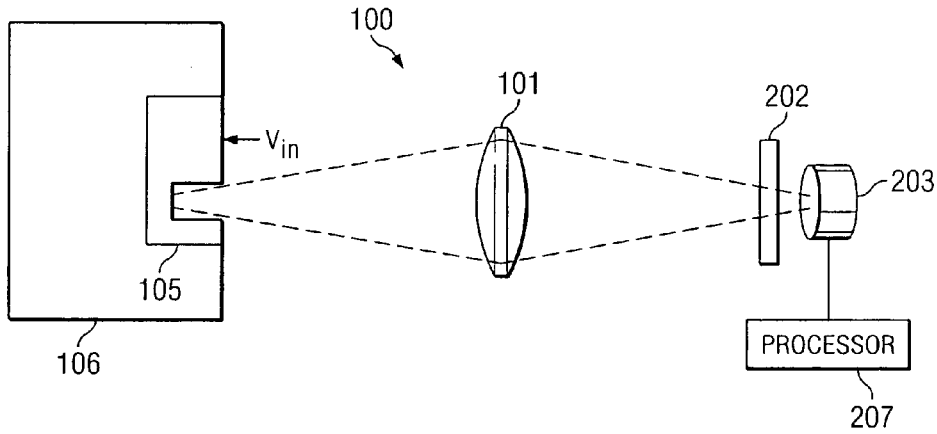
FIG. 2 illustrates an alternative embodiment of the spark plug energy analysis system.

FIG. 2 illustrates an alternative embodiment of the invention. System 200 is similar to system 100, except that the lens system 101 passes light to a monochrometer/spectrometer 202 and an ICCD camera 203. Monochrometer or spectrometer detects light as spectral bands, including at least the CN band, and an image is captured by camera 203.

Processing system 207 receives and processes the image, and is programmed to provide spark plug energy characteristics as described above.

The method can be distinguished from methods used to measure the equivalence ratio in the spark gap in spark ignited engines. For these methods, the ignition system provides the same energy to the fresh charge on every cycle. The discharge is the same for every test, and variations in the CN emissions signal are related to differences in the A/F ratio in the spark gap.

As stated above, in the present system, the A/F ratio is fixed and the energy emitted in the spark gap is the measurement of interest. By measuring the amount of energy released, the design of both the spark plug hardware and electronic circuitry can be improved. The non-invasive technique improves the speed of ignition system characterization.

What is claimed is:

1. A system for measuring the thermal energy emitted by an internal combustion spark igniter, comprising:

a chamber for containing the igniter;

wherein a portion of the chamber wall will pass at least the optical wavelength of cyanogenic thermal emissions from the igniter into ambient air outside the chamber;

means for delivering a combustion gas to the igniter;

means for activating the igniter within the chamber;

an optical path in which the emissions pass through ambient air to a bandpass filter, then one or more lenses, then a detector;

the bandpass filter operating to filter out emissions outside the wavelength of the cyanogen component of the thermal emissions;

the one or more lenses operating to focus at least some of the thermal emissions onto the bandpass filter;

the detector operating to detect the level of the cyanogen component of the thermal emissions that pass through the bandpass filter; and a processing system for relating the level of the cyanogen component to the amount of energy released by the igniter.

2. The system of claim 1, wherein the chamber has an internal geometry that simulates an actual engine cylinder.

3. The system of claim 1, wherein the igniter is a spark plug.

4. The system of claim 1, wherein the portion of the chamber wall is an opening in the chamber that is open to the atmosphere outside the chamber.

5. The system of claim 1, wherein the portion of the chamber wall is made from a material that conducts cyanogen emissions from the igniter.

6. The system of claim 1, wherein the means for igniting is an electrical connection to an electrical power source.

7. A system for measuring the thermal energy emitted by an internal combustion spark igniter, comprising:

a chamber for containing the igniter;

wherein a portion of the chamber wall will pass at least the optical wavelength of cyanogen thermal emissions from the igniter into ambient air outside the chamber;

means for delivering a combustion gas to the igniter;

means for activating the igniter within the chamber;

an optical path in which the emissions pass through ambient air to a bandpass filter, then one or more lenses, then a detector;

the detection device operating to detect thermal emissions as one or more spectral bands, including at least the cyanogenic spectral band representing the cyanogen component of the thermal emissions;

the one or more lenses operating to focus at least some of the thermal emissions onto the detection device; and a processing system for receiving a signal representing the level of the cyanogen component from the detector and for relating the level of the cyanogen component to the amount of energy released by the igniter.

8. The system of claim 7, wherein the chamber has an internal geometry that simulates an actual engine cylinder.

9. The system of claim 7, wherein the igniter is a spark plug.

10. The system of claim 7, wherein the portion of the chamber wall is an opening in the chamber that is open to the atmosphere outside the chamber.

11. The system of claim 7, wherein the portion of the chamber wall is made from a material that conducts the cyanogen emissions from the igniter.

12. The system of claim 7, wherein the means for igniting is an electrical connection to an electrical power source.

13. The system of claim 7, further comprising a camera for capturing an image of the cyanogenic spectral band.

14. The system of claim 7, wherein the detection device is a monochromator.

15. The system of claim 7, wherein the detection device is a spectrometer.

16. A method for measuring the thermal energy emitted by a internal combustion spark igniter, comprising:

placing the igniter in a combustion chamber;

igniting the igniter in the chamber, using a combustion gas having a known air-fuel ratio;

wherein a portion of the chamber wall will pass at least the optical wavelength of cyanogen thermal emissions from the igniter into ambient air outside the chamber such that the emissions follow and open optical path to a detector;

detecting the level of the cyanogen component of the thermal emissions that pass through a bandpass filter; and relating the level of the cyanogen component to the amount of energy released by the igniter.

17. The method of claim 16, further comprising repeating the igniting step for a number of different igniters and comparing the results of the detecting step.

18. The method of claim 16, wherein the detecting step is performed using a bandpass filter that passes at least the cyanogen component of the thermal emissions to a detector.

19. The method of claim 16, wherein the detecting step is performed using a monochromator or spectrometer to detect the spectral band representing the cyanogen component of the thermal emissions.

20. The method of claim 16, wherein the combustion gas further has a known equivalence ratio.

21. The method of claim 16, wherein the placing step is performed by placing the igniter in situ in a combustion chamber of an engine.

22. A system for measuring the thermal energy emitted by an internal combustion igniter, comprising:

a chamber for containing the igniter;

wherein a portion of the chamber wall will pass at least the optical wavelength of cyanogenic thermal emissions from the igniter;

wherein the portion of the chamber wall is an opening in the chamber that is open to the atmosphere outside the chamber;

means for delivering a combustion gas to the igniter;

means for activating the igniter within the chamber;

a bandpass filter for filtering out emissions outside the wavelength of the cyanogen component of the thermal emissions;

one or more lenses for focusing at least some of the thermal emissions onto the bandpass filter;

a detector for detecting the level of the cyanogen component of the thermal emissions that pass through the bandpass filter; and a processing system for relating the level of the cyanogen component to the amount of energy released by the igniter.

23. A system for measuring the thermal energy emitted by an internal combustion igniter, comprising:

a chamber for containing the igniter;

wherein a portion of the chamber wall will pass at least the optical wavelength of cyanogen thermal emissions from the igniter;

wherein the portion of the chamber wall is an opening in the chamber that is open to the atmosphere outside the chamber;

means for delivering a combustion gas to the igniter;

means for activating the igniter within the chamber;

a detection device that detects thermal emissions as one or more spectral bands, including at least the cyanogenic spectral band representing the cyanogen component of the thermal emissions;

one or more lenses for focusing at least some of the thermal emissions onto the detection device; and a processing system for receiving a signal representing the level of the cyanogen component from the detector and for relating the level of the cyanogen component to the amount of energy released by the igniter.

* * * * *